US005079114A

United States Patent [19]

Williams

[11] Patent Number: 5,079,114

[45] Date of Patent: Jan. 7, 1992

[54] BIASING SWITCHING BETWEEN TRI-LEVEL AND BI-LEVEL DEVELOPMENT

[75] Inventor: James E. Williams, Rochester, N.Y.

[73] Assignee: Xerox Corporation, Stamford, Conn.

[21] Appl. No.: 440,914

[22] Filed: Nov. 22, 1989

[51] Int. Cl.[5] ..... G03G 13/01

[52] U.S. Cl. ..... 430/42; 430/45; 430/54

[58] Field of Search ..... 430/42, 45, 54

[56] References Cited

U.S. PATENT DOCUMENTS 4,841,335 1/1989 Kohyama ..... 430/42 X 4,920,024 4/1990 Williams ..... 430/45

FOREIGN PATENT DOCUMENTS 0138439 10/1979 Japan ..... 430/42

*Primary Examiner*—Marion E. McCamish

*Assistant Examiner*—Steve Crossan

[57] ABSTRACT

Image creation apparatus operable in a tri-level high-light color imaging or a black monochrome mode. The developer structures are biased in the tri-level mode using a chopped DC bias while in the monochrome black mode only the black developer structure is biased using a standard monochrome bias.

9 Claims, 3 Drawing Sheets

BIASING SWITCHING BETWEEN TRI-LEVEL AND BI-LEVEL DEVELOPMENT

BACKGROUND OF THE INVENTION

This invention relates generally to tri-level highlight color printing and, more particularly, to developer bias switching between a standard DC bias and a chopped DC bias for enabling tri-level highlight color and bi-level black imaging utilizing the same development system for each.

The invention can be utilized in the art of xerography or in the printing arts. In the practice of conventional xerography, it is the general procedure to form electrostatic latent images on a xerographic surface by first uniformly charging a photoconductive insulating surface of photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner paricles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e. CAD) stays at the full photoreceptor potential ($V_{ddp}$ or $V_{cad}$, see FIGS. 1*a* and 1*b*). The other image is exposed to discharge the photoreceptor to its residual potential, i.e. $V_c$ or $V_{dad}$ (typically 100 v) which corresponds to discharged area images that are subsequently developed by discharged-area development (DAD). The background areas exposed such as to reduce the photoreceptor potential to halfway between the $V_{cad}$ and $V_{dad}$ potentials, (typically 500 v) and is referred to as $V_w$ or $V_{white}$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

Because the composite image developed on the charge retentive surface consists of both positive and negative toner a pre-transfer corona charging step is necessary to bring all the toner to a common polarity so it can be transferred using corona charge of the opposite polarity.

Various techniques have heretofore been employed to develop electrostatic images as illustrated by the following disclosures which may be relevant to certain aspects of the present invention.

U.S. Pat. No. 4,761,668 granted to Parker et al and assigned to the same assignee as the instant application which relates to tri-level printing discloses apparatus for minimizing the contamination of one dry toner or developer by another dry toner or developer used for rendering visible latent electrostatic images formed on a charge retentive surface such as a photoconductive imaging member. The apparatus causes the otherwise contaminating dry toner or developer to be attracted to the charge retentive surface in its inter-document and outboard areas. The dry toner or developer so attracted is subsequently removed from the imaging member at the cleaning station.

U.S. Pat. No. 4,761,672 granted to Parker et al and assigned to the same assignee as the instant application which relates to tri-level printing discloses apparatus wherein undesirable transient development conditions that occur during start-up and shut-down in a tri-level xerographic system when the developer biases are either actuated or deactuated are obviated by using a control strategy that relies on the exposure system to generate a spatial voltage ramp on the photoreceptor during machine start-up and shut-down. Furthermore, the development systems' bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and developing characteristics, the charging of the photoreceptor can be varied in accordance with the change of developer bias voltage.

U.S. Pat. No. 4,811,046 granted to Jerome E. May and assigned to the same assignee as the instant application which relates to tri-level printing discloses apparatus wherein undesirable transient development conditions that occur during start-up and shut-down in a tri-level xerographic system when the developer biases are either actuated or deactuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in the contact-prevention direction to permit use of the tri-level system to be utilized as a single color system or for the purpose of agitating developer in only one of the housings at a time to insure internal triboelectric equilibrium of the developer in that housing.

U.S. Pat. No. 4,771,314 granted to Parker et al and assigned to the same assignee as the instant application which relates to tri-level printing discloses printing apparatus for forming toner images in black and at least one highlighting color in a single pass of a charge retention imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

U.S. Pat. No. 4,833,504 granted to Parker and assigned to the same assignee as the instant application which relates to tri-level printing discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complementary half of a tri-level latent image while at the same time allowing the already developed first half to pass through the second housing with minimum image disturbance.

U.S. patent application Ser. No. 220,408 filed on June 28, 1988 in the name of Parker et al and assigned to the same assignee as the instant application which relates to tri-level printing discloses an electronic printer employing tri-level xerography to superimpose two images with perfect registration during the single pass of a charge retentive member past the processing stations of the printer. One part of the composite image is formed using Magnetic Ink Character Recognition (MICR) toner, while the other part of the image is printed with less expensive black, or color toner. For example, the magnetically readable information on a check is printed with MICR toner and the rest of the check in color or in black toner that is not magnetically readable.

The problem of fringe field development in a tri-level highlight color, single pass imaging system is addressed in U.S. Pat. No. 4,847,655 assigned to the same assignee as the instant invention and granted to Parker et al on July 11, 1989. In this application there is disclosed a magnetic brush developer apparatus comprising a plurality of developer housings each including a plurality of magnetic brush rolls associated therewith. Conductive magnetic brush (CMB) developer is provided in each of the developer housings. The CMB developer is used to develop electronically formed images. The developer conductivity, as measured in a powder electrical conductivity cell, is in the range of $10^{-9}$ to $10^{-13}$ (ohm-cm)-1. The toner concentration of the developer is in the order of 2.0 to 3.0% by weight and the toner charge level is less than 20 microcoulombs/gram and the developer rolls are spaced from the charge retentive surface a distance in the order of 0.40 to 0.120 inch.

U.S. Pat. No. 4,868,611 granted on Sept. 9, 1989 to Richard P. Germain and assigned to the same assignee as the instant invention discloses a highlight color imaging method and apparatus including structure for forming a single polarity charge pattern having at least three different voltage levels on a charge retentive surface wherein two of the voltage levels correspond to two image areas and the third voltage level corresponds to a background area. Interaction between developer materials contained in a developer housing and an already developed image in one of the two image areas is minimized by the use of a scorotron to neutralize the charge on the already developed image.

In high speed (i.e. 135 cpm) xerographic printing excellent copy quality can be obtained by the use of a hybrid development system as disclosed in U.S. Pat. No. 4,537,494, granted to A. Lubinsky et al on Aug. 27, 1985. The '494 patent discloses the use of a somewhat insulative developer material. When attempting to do highlight color utilizing tri-level xerography in a high speed printer, the development system disclosed in the '494 patent becomes undesirable due to its insulative nature. With an insulative development system, higher development fields are needed to obtain the same developed mass/area (DMA) as would be needed with a conductive system. It also tends to develop fringe fields.

Tri-level xerography requires the development of two images within the same voltage space that is normally used for one image in standard bi-level xerography. As a result, the effective development and cleaning fields available in tri-level imaging are about half that of normal xerography. These lower fields make it more difficult to develop enough toner on the photoreceptor latent image in order to obtain acceptable output densities on paper, while still maintaining acceptable background suppression. While tri-level xerography can achieve sufficient development of both colors with acceptable background, the reduced operating latitudes (as compared to bi-level monochrome xerography) require that process parameters such as Toner Concentration (TC) and photoreceptor electrostatics be carefully controlled, and that the available voltage space of the photoreceptor be maximized (resulting in lower photoreceptor life).

A conductive development system is preferably used in tri-level imaging so that higher DMA's (developed mass/area) for a given background level can be achieved with these lower development fields. The conductive material also suppresses fringe field development which can cause black development around the edges of a color image or visa versa.

U.S. patent application Ser. No. 07/440,913 assigned to the same assignee as the instant application and filed in the USPTO in the name of Germain et al on the same day discloses the use of Chopped DC biases applied to developer structures containing Conductive Magnetic Brush (CMB) developer for extending the operating latitude of tri-level highlight color imaging.

BRIEF SUMMARY OF THE INVENTION

In accordance with the present invention, the developer biases in a tri-level highlight color printer are switched between standard DC and chopped DC bias modes. The standard DC bias mode is used to obtain excellent black copy quality in the black monochrome mode using Insulative Magnetic Brush (IMB) developer. The chopped DC bias mode is used to increase the DMA and reduce undesirable fringe field development in the black housing when printing in the tri-level highlight color mode. Thus, tri-level highlight color printing can be achieved in a high speed printer which utilizes a black (IMB) developer by using chopped DC bias (CDC) in the highlight color mode while still preserving the excellent quality monochromatic black images by electrically biasing the black developer housing using a conventional DC bias while operating in a first mode of operation.

The operating latitude of the tri-level highlight color operating mode is extended by switching from the standard DC bias applied to the black developer housing to a chopped DC (CDC) developer bias. By chopped DC bias is meant that the housing bias applied to the developer housing is alternated between two discrete potentials, one that represents roughly the conventional bias for the DAD developer and the other that represents a bias that is considerably more negative than the conventional bias, the former being identified as $V_{Bias}$ Low and the latter as $V_{Bias}$ High. This alternation of the bias takes place in a periodic fashion at a given frequency, with the period of each cycle divided up between the two bias levels at a duty cycle of from 5–10% (Percent of cycle at $V_{BIAS}$ High). In the case of the CAD image, the amplitude of both $V_{BIAS}$ Low and $V_{BIAS}$ HIGH are about the same as for the DAD housing case, but the wavelength is inverted in the sense that the bias on the CAD housing is at $V_{BIAS}$ High for a duty cycle of 90–95%.

I have found through experimentation that several benefits are associated with CDC biasing in the tri-level highlight color mode:

Increased developed mass/area (DMA) for a given background level.

An increase in developed charge/mass (Q/M), which reduces the amount of color image damage caused by the second CAD black developer housing.

A consistent increase of 25–40 volts in the development neutralization of both the DAD and CAD latent images.

The increases in the DMA and Q/M when using a Chopped DC bias, and the resultant increase in image neutralization, is used to improve the operating latitude in several different ways. The increased developability that is obtained when using the Chopped DC bias instead of an equivalent conventional DC bias can be used to either obtain higher DMA's for the same background level, or to obtain the same DMA as the DC bias case, but with reduced development fields. The reduced development fields in the latter case would make available photoreceptor voltage that could be applied elsewhere (i.e.: red and black cleaning fields, or reduction of photoreceptor voltages). The higher developed Q/M helps to decrease the amount of red image damage caused by the second CAD black housing. The increased neutralization helps to prevent the development of black carrier beads and wrong sign toner into the first (DAD) image by the second (CAD) developer housing.

The end result of bias switching is to produce excellent black copy quality in the black monochrome mode in high speed printing, while both enabling tri-level highlight color and extending the operating latitude in the tri-level highlight color mode.

DETAILED DESCRIPTION OF THE PREFERRED EMBODIMENT OF THE INVENTION

Figure 1A:
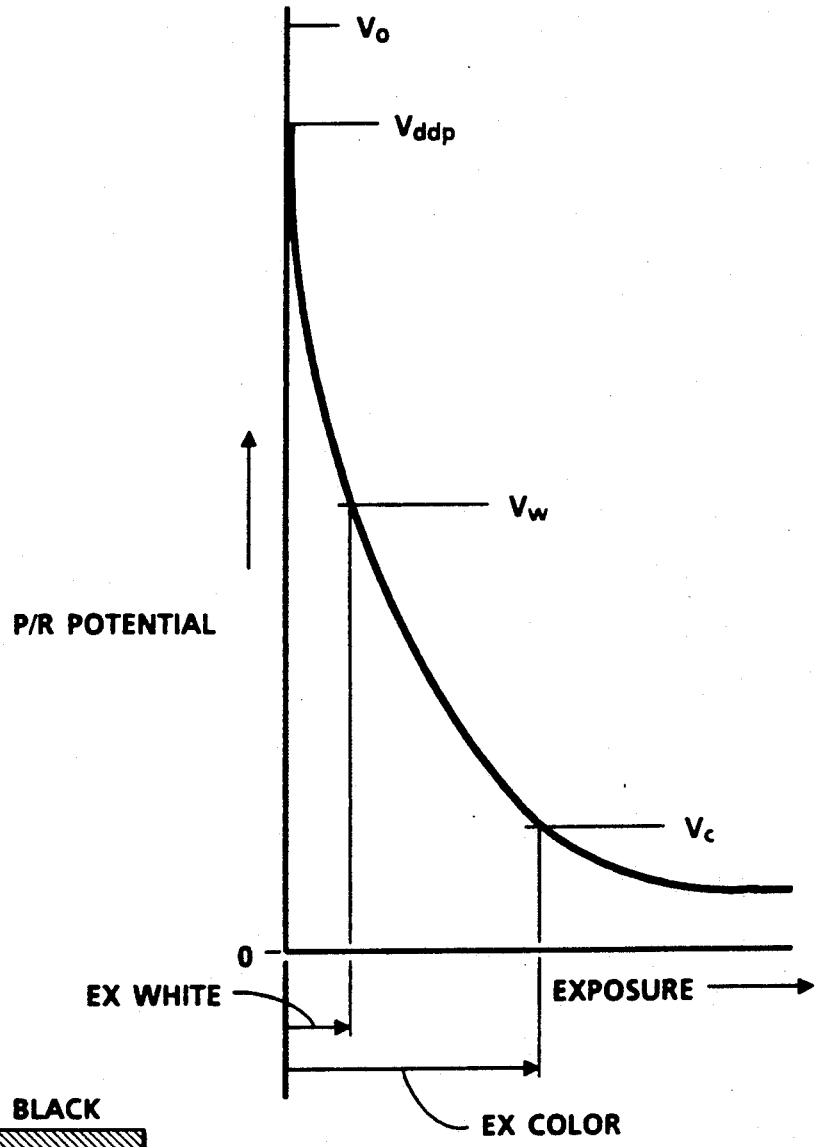
FIG. 1*a* is a plot of photoreceptor potential versus exposure illustrating a tri-level electrostatic latent image.
Figure 1B:
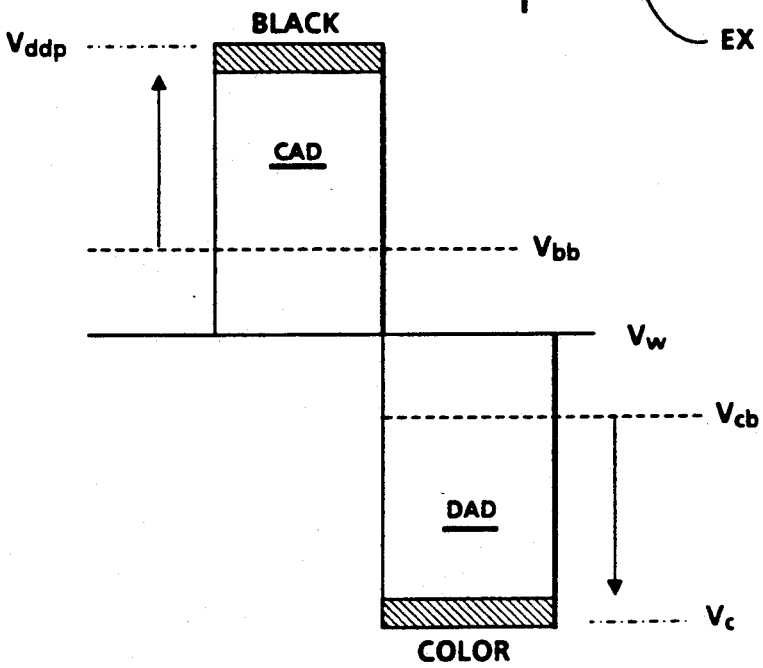
FIG. 1*b* is a plot of photoreceptor potential illustrating single-pass, highlight color latent image characteristics.

For a better understanding of the concept of tri-level imaging, a description thereof will now be made with reference to FIGS. 1*a* and 1*b*. FIG. 1*a* illustrates the tri-level electrostatic latent image in more detail. Here $V_o$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved by passing the photoreceptor through two developer housings in tandem which housings are electrically biased to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electric field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electric field existing between the photoreceptor and the development rolls in the first housing at bias voltage $V_{cb}$ (V color bias).

Figure 2:
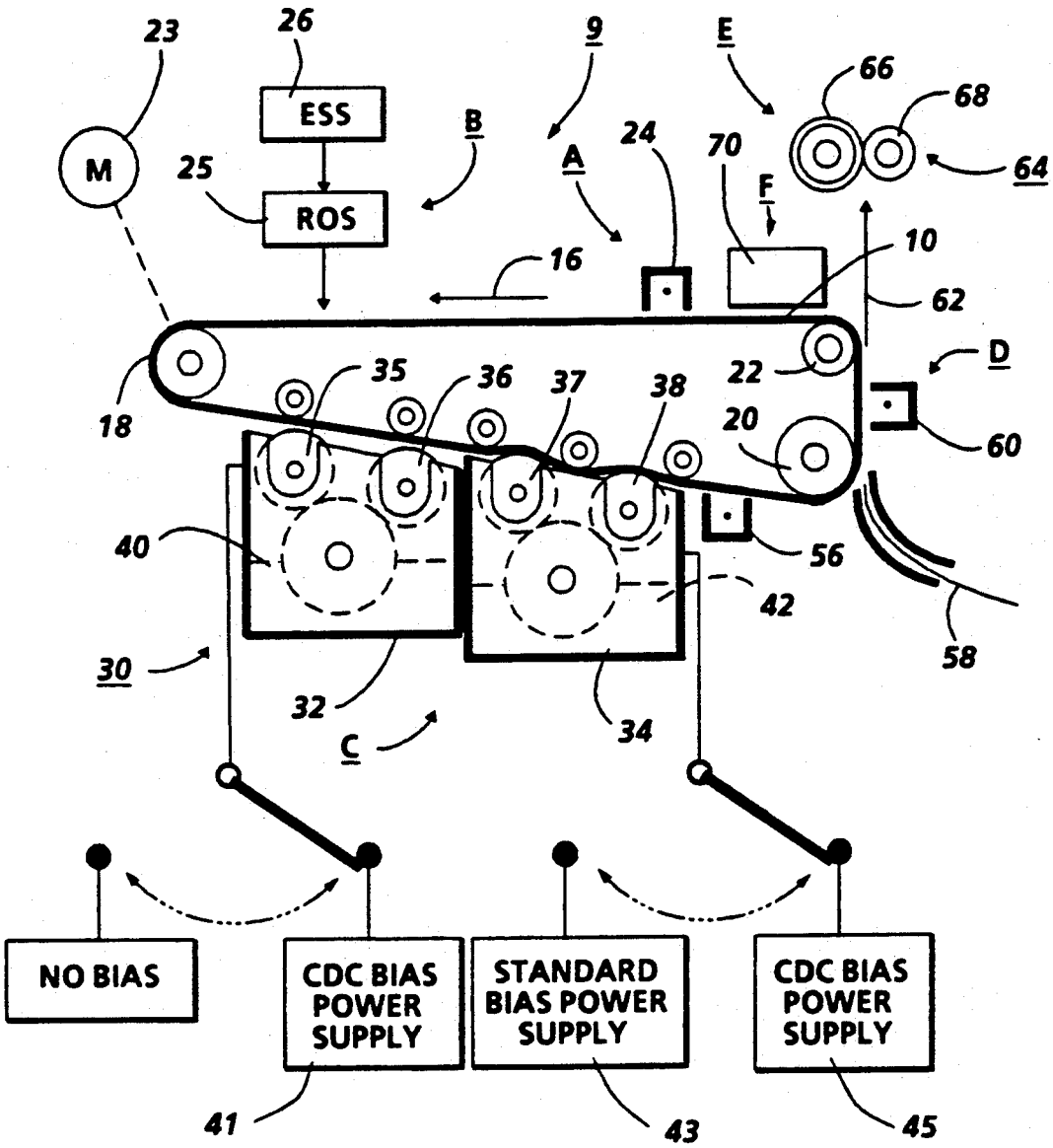
FIG. 2 is schematic illustration of a printing apparatus incorporating the inventive features of our invention.

As shown in FIG. 2, a printing machine 9 incorporating our invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. Activation of the scanner 25, as well as other components of the printing apparatus 9 are controlled by the Electronic Subsystem (ESS) 26.

The photoreceptor, which is initially charged to a voltage $V_o$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1a.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41, 43 and 45 electrically connected to respective developer housings 32 and 34.

Figure 3:
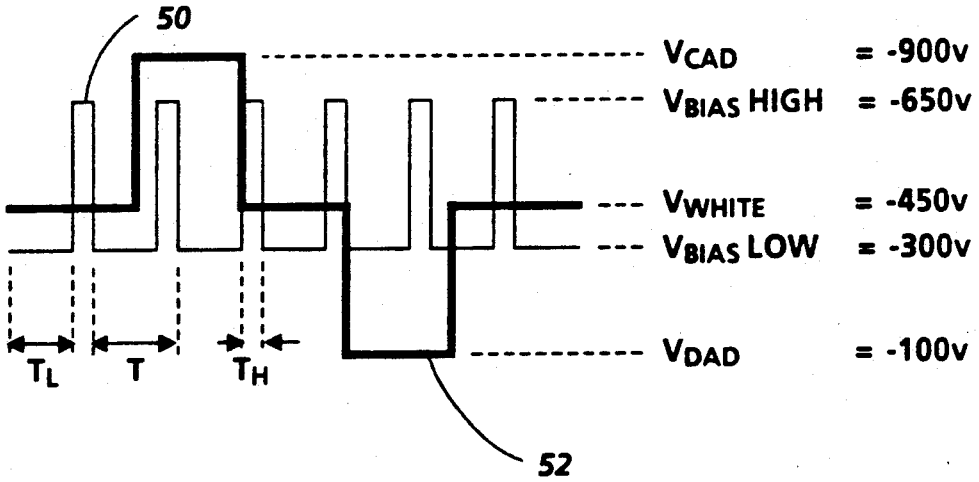
FIG. 3 depicts a tri-level image with a plot of developer bias voltage superimposed thereover which plot illustrates a typical duty cycle for the voltage applied to a DAD developer housing wherein the period for the high bias voltage is approximately 5 to 10% of the total period.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first) contains two-component red conductive magnetic brush (CMB) developer 40 having triboelectric properties such that the red toner is driven to the last highly charged areas at the potential $V_{DAD}$ of the latent image by the electrostatic field (development field) between the photoreceptor and the development rolls 35, 36. In the tri-level highlight color mode, the rolls are alternately biased at $V_{Bias}$ High and $V_{Bias}$ Low as shown in FIG. 3 via bias power supply 41 which applies a CDC bias to the rolls 35, 36. In the monochrome black printing mode the biases are removed from the rolls 35, 36 via switch via switch 47.

Figure 4:
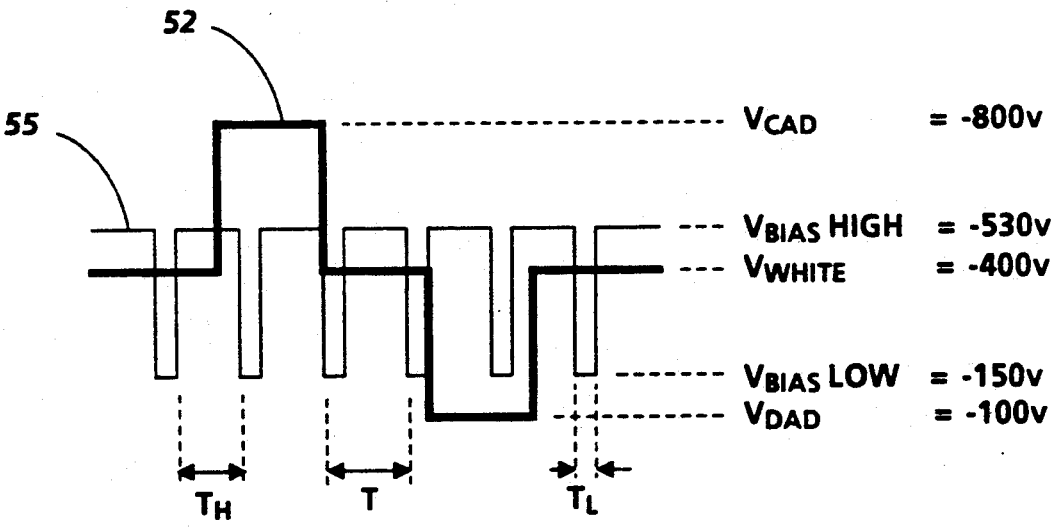
FIG. 4 depicts a tri-level image with a plot of developer bias voltage superimposed thereover which plot illustrates a typical duty cycle for the voltage applied to a CAD developer housing wherein the period for the high bias voltage is approximately 90 to 95% of the total period.

The triboelectric charge on the black insulative magnetic brush (IMB) developer 42 in the second housing is chosen so that the black toner is urged towards the parts of the latent image at the most highly charged potential $V_{CAD}$ by the electrostatic field (development field) existing between the photoreceptor and the development rolls 37, 38 in the second housing. In the tri-level highlight color printing mode, the rolls are alternately biased at $V_{Bias}$ High and $V_{Bias}$ Low via the CDC power supply 45 as shown in FIG. 4. In the monochrome black printing mode, the conventional DC bias is applied to the rolls 37, 38 via the standard bias power supply 43 through switch 49. As shown in FIG. 2, the rolls 37 and 38 and adjacent backup rolls disposed to the other side of the photoreceptor belt 10 are arranged so that the belt is wrapped about the rolls 37, 38. While only two rolls 37 and 38 are contained in the housing 34, the use of three rolls is contemplated.

As disclosed in FIG. 3, a waveform 50 depicts the bias voltage according to the present invention for the DAD developer housing 32. The waveform 50 is superimposed upon a typical tri-level image represented by reference character 52. As can be seen from the waveform 50, the DAD bias is alternated between two potentials represented by $V_{Bias}$ High and $V_{Bias}$ Low. Such alternation takes place in a periodic fashion such that the period. $T_H$ for $V_{Bias}$ High equals approximately 6% of the total period, T at a frequency of 5 kHz and the period, $T_L$ is approximately 94% thereof. By way of example, in an operative embodiment of the invention the DC bias levels for $V_{Bias}$ High and $V_{Bias}$ Low are −650 and −300 volts, respectively. The DAD image was recorded at a voltage level of −100 volts while the CAD voltage was at −900 volts with the background at −450 volts.

In the case of the CAD image as illustrated in FIG. 4, the bias voltages $V_{Bias}$ High and $V_{Bias}$ Low are −530 and −150 volts, respectively. The waveform 55 representing these biases is inverted with respect to the waveform 50 in the sense that the period, $T_H$ for $V_{Bias}$ High is approximately 94% of the total period, T while the period $T_L$ for $V_{Bias}$ Low is approximately 6% of the total period T.

Developer bias switching between $V_{Bias}$ High and $V_{Bias}$ Low is effected automatically via the power supplies 41 and 45 under the control of the ESS 26.

Because the composite image developed on the photoreceptor consists of both positive and negative toner, a postive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to the cleaning, a discharge lamp (not shown) floods the photoconductive surface with light to dissipate any residual electrostatic charge remaining prior to the charging thereof for the successive imaging cycle.

What is claimed is:

1. A method of forming images on a charge retentive surface, said method including the steps of:

in one mode of operation, forming a tri-level latent image including a CAD image area and a DAD image area of the same polarity and a background area having the same polarity as said CAD and DAD image areas;

in another mode of operation, forming a bi-level latent image including a CAD image area and a background area;

providing CAD and DAD developer structures for selectively developing tri-level latent electrostatic images and bi-level latent electrostatic images;

during said one mode of operation, alternately applying a pair of discrete voltage biases to said CAD developer structure to thereby develop said CAD image area, one of said pair of discrete voltage biases applied to said CAD developer structure being applied for a longer period of time than the other of said discrete voltage biases;

during said one mode of operation, alternately applying a pair of discrete voltage biases to said DAD developer structure to thereby develop said DAD image area, said discrete voltage biases applied to said DAD developer structure being different from said pair of discrete voltage biases applied to said CAD developer structure, one of said discrete voltage biases applied to said DAD developer structure being applied for a longer period of time than the other of said discrete voltage biases of said pair;

during said another mode of operation, applying a DC bias to said CAD developer structure and applying no bias to said DAD developer structure to thereby develop said CAD image area of said bi-level latent image for each of said modes of operation transferring developed image areas to a substrate; and removing residual developer material from said charge retentive surface before switching modes or before making another image in the same mode.

2. The method according to claim 1 wherein the step of alternately applying a pair of discrete voltage biases to said CAD developer structure comprises applying the higher of the pair of biases for a longer period of time than the lower of the pair of biases and the step of alternately applying a pair of discrete voltage biases to said DAD developer structure comprises applying the higher of the pair of biases for a shorter period of time than the lower of the pair of biases.

3. The method according to claim 2 wherein the step of providing CAD and DAD developer structures comprises providing insulative developer in the CAD developer structure.

4. The method according to claim 3 wherein the step of providing CAD and DAD developer structures comprises providing the CAD developer structure with a plurality of developer rolls and effecting a wrapping relationship between said rolls and said charge retentive surface.

5. The method according to claim 2 wherein the step of applying the higher of the pair of discrete biases applied to said CAD developer structure has a duty cycle in the range of 90 to 95%.

6. The method according to claim 5 wherein the step of applying the higher of the pair of discrete biases applied to said DAD developer structure has a duty cycle in the range of 5 to 10%.

7. A method of forming images on a charge retentive surface, said method including the steps of:

forming a plurality of images on a charge retentive surface;

providing a plurality of developer structures;

in one mode of operation, alternately applying a high and a low bias voltage to said plurality of developer structures for developing at said plurality of images and applying one of said bias voltages for a longer period of time than the other bias voltage;

in another mode of operation, applying a single DC bias to one of said developer structures for developing another of said images and for each of said modes of operation transferring developed image areas to a substrate; and removing residual developer material from said charge retentive surface.

8. The method according to claim 7 wherein the high bias applied to one of said plurality of developer structures is applied for a longer period of time than the low bias applied thereto and the low bias applied to the other of said developer structures is applied for a longer period of time than the high bias applied thereto.

9. The method according to claim 8 wherein the biases applied for a longer time have a duty cycle in the order of 90 to 95%.

* * * * *